US007267521B1

(12) United States Patent
Smith

(10) Patent No.: US 7,267,521 B1
(45) Date of Patent: Sep. 11, 2007

(54) BACKHOE BUCKET REVERSE ADAPTER

(76) Inventor: Tyson Smith, 855 Sussex Rd., San Jacinto, CA (US) 92583

( * ) Notice: Subject to any disclaimer, the term of this patent is extended or adjusted under 35 U.S.C. 154(b) by 122 days.

(21) Appl. No.: 11/267,615

(22) Filed: Nov. 7, 2005

(51) Int. Cl.
*E02F 3/96* (2006.01)

(52) U.S. Cl. ..... 414/723; 37/468

(58) Field of Classification Search ..... 414/723; 37/468; 172/272–275
See application file for complete search history.

(56) References Cited

U.S. PATENT DOCUMENTS

| | | | |
|---|---|---|---|
| 3,130,843 | A | 4/1964 | Kelly |
| 3,189,203 | A | 6/1965 | Brocklebank et al. |
| 3,195,747 | A | 7/1965 | Kashergen |
| 3,934,738 | A | 1/1976 | Arnold |
| 4,127,203 | A | 11/1978 | Arnold |
| 4,279,085 | A | 7/1981 | Arnold |
| 4,311,428 | A | 1/1982 | Arnold |
| 4,345,872 | A | 8/1982 | Arnold |
| 4,457,085 | A | 7/1984 | Arnold |
| 4,531,883 | A | 7/1985 | Arnold |
| 4,632,595 | A | 12/1986 | Schaeff |
| 4,679,337 | A | 7/1987 | Carternock et al. |
| 4,804,309 | A | 2/1989 | Risch |
| 4,824,319 | A | 4/1989 | Arnold |
| 4,906,161 | A | 3/1990 | Weyer |
| 4,938,651 | A | 7/1990 | Gilmor et al. |
| 4,948,328 | A | 8/1990 | Busch |
| 4,958,981 | A | 9/1990 | Uchihashi |
| 5,108,252 | A | 4/1992 | Gilmore, Jr. et al. |
| 5,140,760 | A | 8/1992 | Mannbro |
| 5,145,313 | A | 9/1992 | Weyer |

(Continued)

FOREIGN PATENT DOCUMENTS

| | | |
|---|---|---|
| GB | 872458 | 7/1961 |

OTHER PUBLICATIONS

Woods Equipment Company, www.WoodsConstruction.net, Wain-Roy Coupler, Oct. 28, 2005, 2 pages.

(Continued)

*Primary Examiner*—Donald Underwood
(74) *Attorney, Agent, or Firm*—Cislo & Thomas, LLP

(57) ABSTRACT

A backhoe bucket reverse adapter is provided which can be interposed between a conventional Wain-Roy-style or Gannon-style backhoe arm bucket coupling assembly and a backhoe bucket so as to reverse the orientation of the backhoe bucket. The adapter is provided with an open framework and a rear end cross-connector having a tubular configuration corresponding to the tubular steel back cross-connecting member located at the top of a conventional Wain-Roy-style or Gannon-style backhoe bucket. The adapter has a pair of hook elements that are oriented in a forward direction, away from the chassis of the backhoe vehicle and in an opposite direction from the hook elements of a conventional backhoe coupling system. The hook elements of the backhoe bucket adapter can be utilized to engage a back cross-connecting member located at the top of a conventional bucket, while the structure of the adapter receives the oppositely directed hook elements of a conventional backhoe coupling assembly. The adapter is releaseably coupled to both the bucket and the conventional backhoe coupling assembly by means of a pair of releaseable latch pins. The orientation of a Wain-Roy-style or Gannon-style backhoe bucket on its mounting arm can thereby quickly and easily reversed as desired.

16 Claims, 7 Drawing Sheets

U.S. PATENT DOCUMENTS

| | | | |
|---|---|---|---|
| 5,199,844 | A | 4/1993 | Gilmore, Jr. et al. |
| 5,242,258 | A | 9/1993 | Weyer |
| 5,332,353 | A | 7/1994 | Arnold |
| 5,467,542 | A | 11/1995 | Hulden |
| 5,611,158 | A | 3/1997 | Pratt et al. |
| 5,621,987 | A | 4/1997 | Pratt et al. |
| 5,634,735 | A | 6/1997 | Horton et al. |
| 5,727,342 | A | 3/1998 | Horton |
| 5,865,492 | A | 2/1999 | Horton |
| 5,966,850 | A | 10/1999 | Horton |
| 5,974,706 | A | 11/1999 | Kaczmarski et al. |
| 5,983,535 | A | 11/1999 | Kaczmarski et al. |
| 6,163,988 | A | 12/2000 | Pratt et al. |
| 6,370,801 | B1 | 4/2002 | Weyer et al. |
| 2003/0221340 | A1 | 12/2003 | Ganswich |

OTHER PUBLICATIONS

Woods Equipment Company, www.WoodsConstruction.net, Gannon Eliminator System, Oct. 28, 2005, 2 pages.

BACKHOE BUCKET REVERSE ADAPTER

BACKGROUND OF THE INVENTION

1. Field of the Invention

The present invention relates to an adapter for an earth-moving, excavation backhoe that allows the orientation of the bucket relative to the backhoe vehicle chassis to be quickly and easily reversed.

2. Description of the Prior Art

The present invention is an adapter that allows reversal of the orientation of a backhoe that is used to move large scoops of soil or other excavation material. A conventional backhoe has an elongated arm to which a backhoe bucket is attached. The open mouth of the bucket is oriented to face the chassis of the backhoe. The bucket is coupled to the backhoe arm, typically by means of a releaseable coupler.

Two popular versions of such a coupler are sold by Woods Equipment Company and are know in the trade as the Wain-Roy-style coupler and the Gannon-style coupler. Both of these coupling devices are formed of open frame structures that are attached near the end of an L-shaped or dogleg-shaped bucket guide link member that is attached to the arm of the backhoe. The coupler member has a hinged connection coupled to the backhoe arm and a pair of hooks that are directed back toward the chassis of the backhoe. The bucket guide link member is pushed and pulled by a hydraulic piston to rotate the coupler member downwardly so that the hooks are forced back toward the chassis of the vehicle, or pulled so that the hooks are drawn away from the chassis of the vehicle. The hooks engage a transverse four-inch diameter steel tube located at the top edge of the mouth of the bucket opposite the scooping teeth thereof.

In the Gannon-style and Wain-Roy-style coupling systems, a transverse coupling faceplate joins the ends of the outboard sides of the coupler frame together. The transverse faceplate has an opening or eye that receives a pin that also passes through a corresponding eye in a plate or latch pin tang projecting from the backside of the bucket. The latch pin tang is spaced some distance from the four-inch transverse steel back cross-connecting tube. A hook receiving cavity is located in the backside of the bucket between the back cross-connecting tube and the latch pin tang.

To attach the bucket to the arm of the backhoe, the hooks are directed underneath the four-inch transverse steel back cross-connecting tube so that they engage the backside of the bucket from underneath the tube. A releaseable locking pin is engaged in the mutually aligned eyes on the transverse faceplate of the coupler and on the latch pin tang on the back of the bucket of the backhoe. The bucket can be quickly released by withdrawing the releaseable locking pin and rotating the hooks out of engagement from beneath the steel tube on the backside of the bucket.

In some circumstances it is highly desirable for a backhoe bucket to be reoriented so as to scoop forwardly, away from the chassis of the backhoe vehicle. This would be advantageous, for example, for scooping out soil from beneath a flat slab, such as a roadway.

Until the present invention there has been no system for easily adapting the Wain-Roy-style or Gannon-style couplers to allow the orientation of a backhoe bucket to be reversed. The present invention provides an adapter that is extremely simple in construction and very effective for this purpose.

The adapter of the present invention is formed of a pair of side plates joined together at one end by a transverse plate and at the other end by a four-inch diameter steel tube. A pair of hooks, corresponding to the hooks of the backhoe lift member, project from the bottom of the adapter, but are directed in the opposite direction from the hooks on the backhoe coupling member.

To reverse the orientation of the backhoe bucket, the backhoe bucket reverse adapter of the present invention is interposed between the Wain-Roy-style or Gannon-style backhoe coupler and the excavation bucket. The backhoe bucket reverse adapter of the present invention has a corresponding backhoe arm attachment tang with an eye that allows it to be coupled to the eye on the transverse coupling faceplate of the Wain-Roy-style or Gannon-style coupler. It also has a bucket attachment tang with an eye that allows connection of the adapter to the eye-flange on the backside of the backhoe bucket. By interposing the adapter of the present invention between the coupler and the bucket, the backhoe bucket can be reversed relative to the backhoe vehicle chassis in orientation.

SUMMARY OF THE INVENTION

In one broad aspect the present invention may be considered to be a backhoe bucket reverse adapter designed for use with a backhoe arm having a depending bucket hook assembly. The backhoe bucket reverse adapter is also designed for use with a backhoe bucket having a back wall with a cross-connecting member at its top, a latch pin plate at its bottom, and a hook receiving cavity located therebetween. The backhoe bucket reverse adapter of the invention is comprised of an adapter framework, including a pair of transversely separated side plates rigidly joined to each other by opposing transverse, front and rear adapter end connectors. The adapter also includes an adapter hook assembly depending from the adapter framework with at least one hook element having a concave side facing the front adapter end connector. A backhoe arm coupling link member projects upwardly from the front adapter end connector in a direction opposite the adapter hook assembly. An adapter bucket coupling member depends from the transverse rear adapter end connector. The backhoe bucket reverse adapter is preferably formed entirely of steel.

The adapter side plates are cross-connected to each other at their opposing forward and rearward ends. For purposes of reference, the forward end of the backhoe bucket reverse adapter may be considered to be the end toward which the concave surface of the adapter hook element or elements are facing. The rear end of the backhoe bucket reverse adapter may be considered to be the end opposite the forward end. When the backhoe bucket reverse adapter is interposed between the coupling assembly on the backhoe arm and joined to the backhoe bucket, the first or forward end of the backhoe bucket reverse adapter is directed away from the chassis of the backhoe vehicle. Likewise, when the backhoe bucket reverse adapter is connected to both the backhoe arm and to the backhoe bucket, the open mouth of the bucket faces forward, that is away from the chassis of the backhoe vehicle.

The backhoe bucket reverse adapter can be formed as an open framework having a pair of mutually parallel side plates, both of which have straight, flat bottom edges and substantially straight end edges. The first or forward adapter cross-connecting end member of the adapter is preferably an angle-shaped piece that extends across the transverse gap between the two side plates. Similarly, the rear adapter cross-connecting end member is also formed of a trans versely extending angle piece, and in addition, a section of cylindrical tubing.

Although the backhoe bucket reverse adapter can be formed with a single hook element, it is preferably formed with a pair of transversely spaced, mutually parallel hook elements depending from the underside of the bottom plate that extends between the adapter side plates. The two hook elements are preferably spaced slightly inboard from the adapter side plates. It is important for a gap to exist between the bottom plate and at least the rear adapter end connector. This gap is important since the hook element or elements that project downwardly from the coupler at the free extremity of the backhoe arm must pass through this gap so as to capture the rear adapter end connector within the concave cradle or cradles formed by the backhoe arm hook element or elements.

The pair of hook elements on the adapter both depend from the bottom plate of the backhoe bucket reverse adapter to form forwardly facing cradles that receive the cylindrical section of steel tubing located at the top of the backside of the bucket. The cavity in the backside of the bucket beneath this cylindrical steel member accommodates the hooks of either the backhoe arm or the backhoe bucket reverse adapter. The transversely oriented latch pin tang that extends from the backside of the bucket will reside in face to face relationship with the adapter bucket coupling tang, when the backhoe bucket reverse adapter is interposed between the backhoe coupler and the bucket. Alternatively, the bucket latch pin tang is releaseably engageable with the bucket mounting tang on the free end of the backhoe arm when the backhoe bucket reverse adapter is not employed.

In the normal orientation of a backhoe bucket, the open mouth of the bucket faces rearwardly toward the chassis of the backhoe vehicle and the tips of the hooks on the Wain-Roy-style or Gannon-style coupler are directed rearwardly, that is in a direction toward the chassis of the backhoe vehicle. The coupler hooks can then be inserted into the cavity in the back wall of the bucket, and up underneath the cylindrical cross-connecting member at the top of the back wall of the bucket. The latch pin plate or tang on the back wall of the bucket thereupon resides in registration with the forward faceplate of the coupler, that is, the faceplate that faces away from the chassis of the backhoe vehicle. A removable coupling pin can then be inserted through the aligned apertures so as to hold the backhoe bucket on the backhoe coupler in its normal orientation.

However, in some instances it is highly advantageous for the orientation of the backhoe bucket to be reversed. Such a reversal is easily accomplished according to the present invention by interposing the backhoe bucket reverse adapter between the coupling assembly at the free end of the backhoe arm and the backside of the bucket. In this arrangement the coupler hooks at the free end of the backhoe arm that normally engage the cylindrical cross-connection tube at the top of the back wall of the bucket instead engage a similar cylindrical tube formed as a portion of the rear end cross-connecting member of the adapter. The hook or hooks of the adapter project in the opposite direction from the hooks at the free end of the backhoe mounting arm coupler. That is, the adapter hooks face concave forwardly to define a seat for the cross-connecting cylindrical tube at the top end of the back wall, that is the backside of the bucket.

The adapter of the invention has an upwardly projecting tang that resides in face to face disposition with the forward end faceplate of the backhoe coupler. A releaseable pin can then be inserted through openings formed in the backhoe mounting arm coupler forward end faceplate and the upwardly projecting tang of the adapter. A similar releaseable latch pin passes through apertures defined in the tang that projects outwardly from the back wall of the bucket and the bucket coupling link tang on the adapter that projects from the second, rear end cross-connector between the adapter sides.

In another broad aspect the invention may be considered to be a backhoe bucket reverse adapter designed for use both with a backhoe arm having a depending bucket hook assembly and for use also with a backhoe bucket having a back wall with a cavity defined therein to receive the backhoe arm bucket hook assembly. The adapter of the invention is comprised of an adapter framework having transversely separated sides rigidly joined to each other by opposing first and second end cross-connectors. Openings are thereby defined in both the top and bottom of the adapter framework.

The backhoe bucket reverse adapter is further comprised of an adapter hook assembly, a backhoe arm coupling link member, and a bucket coupling link member. The adapter hook assembly has at least one hook element depending from the adapter framework. The hook element or elements are formed concave toward the first, that is, the forward cross-connector and convex toward the second, that is, the rear cross-connector. The backhoe arm coupling link member is preferably a tang that projects from the first end cross-connector between the adapter framework sides in a direction opposite the adapter hook assembly. The bucket coupling link tang of the adapter projects from the second end cross-connector between the adapter sides in a direction opposite the backhoe arm coupling link tang.

The first and second end cross-connectors are respectively comprised of first and second angle pieces extending between the adapter sides at opposing ends thereof. The second cross-connector at the rear of the adapter framework is further comprised of a hollow, cylindrical steel tubular member, preferably having a diameter of four inches. This tubular steel member matches the size and shape of the transverse tubular section of steel located at the top of the backside of the commercially available Gannon-style and Wain-Roy-style buckets.

The backhoe bucket reverse adapter is preferably further comprised of a transverse bottom plate secure to the side plates so as to leave gaps between the bottom plate and both the cross-connectors. The hook element or elements of the adapter hook assembly depend from the bottom plate and are mutually parallel to each other and are set inboard from the adapter framework sides.

The backhoe arm coupling link tang and the bucket coupling link tang that project from the adapter framework in opposite directions from each other are centrally located to project from the first and second cross-members, respectively. Both of the coupling link tangs are formed as steel plates or tongues having latch pin receiving eyes defined therethrough.

In still another aspect the invention may be considered to be the combination of a backhoe arm, a backhoe bucket, and a backhoe bucket reverse adapter. The backhoe arm has a free end and an opposite anchored end. A bucket coupler assembly is rotatably connected to the free end of the backhoe arm. The bucket coupler assembly has a transverse bucket coupler faceplate located at the forward end with a latch pin opening defined therein. The backhoe arm also has a depending hook assembly located between the transverse bucket coupler faceplate and the anchored end of the backhoe arm. The coupler hook assembly depending from the backhoe coupler assembly has at least one, and preferably a pair of transversely spaced coupler hook elements provided thereon. Each coupler hook element is configured concave toward the anchored end of the backhoe arm.

The backhoe bucket has an open mouth at its top and a back wall with a back cross-connecting member at the top of the bucket. A transverse latch pin tang with a latch pin aperture defined therethrough is also provided on the back wall of the backhoe bucket. A hook receiving cavity is defined in the back wall of the bucket between the back cross-connecting member and the transverse latch pin tang.

The backhoe bucket reverse adapter is comprised of an adapter framework, an adapter hook assembly, a transversely oriented backhoe arm coupling link tang, and a transversely oriented adapter bucket coupling tang. The adapter framework is formed with a pair of transversely separated side plates rigidly joined to each other by opposing transverse first and second adapter end connectors. The adapter hook assembly depends from the adapter framework and has at least one hook element having a concave side facing the first adapter end connector and a convex side facing the second adapter end connector. A latch pin opening is defined in the backhoe arm coupling tang at the forward end of the adapter. The backhoe arm coupling tang projects from the first adapter end connector in a direction opposite the adapter hook assembly. The adapter bucket coupling tang at the rear end of the adapter has a latch pin aperture defined therethrough and extends from the transverse second adapter end connector.

The backhoe bucket reverse adapter is interposed between the bucket coupler assembly and the backhoe bucket so that the adapter backhoe arm coupling tang and the coupler assembly faceplate reside in face to face registration and in contact with each other. The openings through the adapter backhoe arm coupling tang and the faceplate of the coupler assembly are in coaxial alignment with each other. The combination further includes a releaseable mounting arm-adapter coupling pin extending through these coaxial openings.

Likewise the backhoe bucket latch pin tang and the adapter bucket coupling tang also reside in face to face registration and in contact with each other. The apertures of the backhoe bucket latch pin tang and the adapter bucket coupling tang are in mutual coaxial alignment with each other. A releaseable adapter bucket coupling pin extends through these apertures. As a consequence, the hook element or elements of the coupler assembly engage the second cross-connecting end connector of the adapter and the hook element or elements of the adapter engage the cross-connecting member at the top of the bucket.

The invention may be described with greater clarity and particularity by reference to the accompanying drawings.

DESCRIPTION OF THE EMBODIMENT

Figure 1:
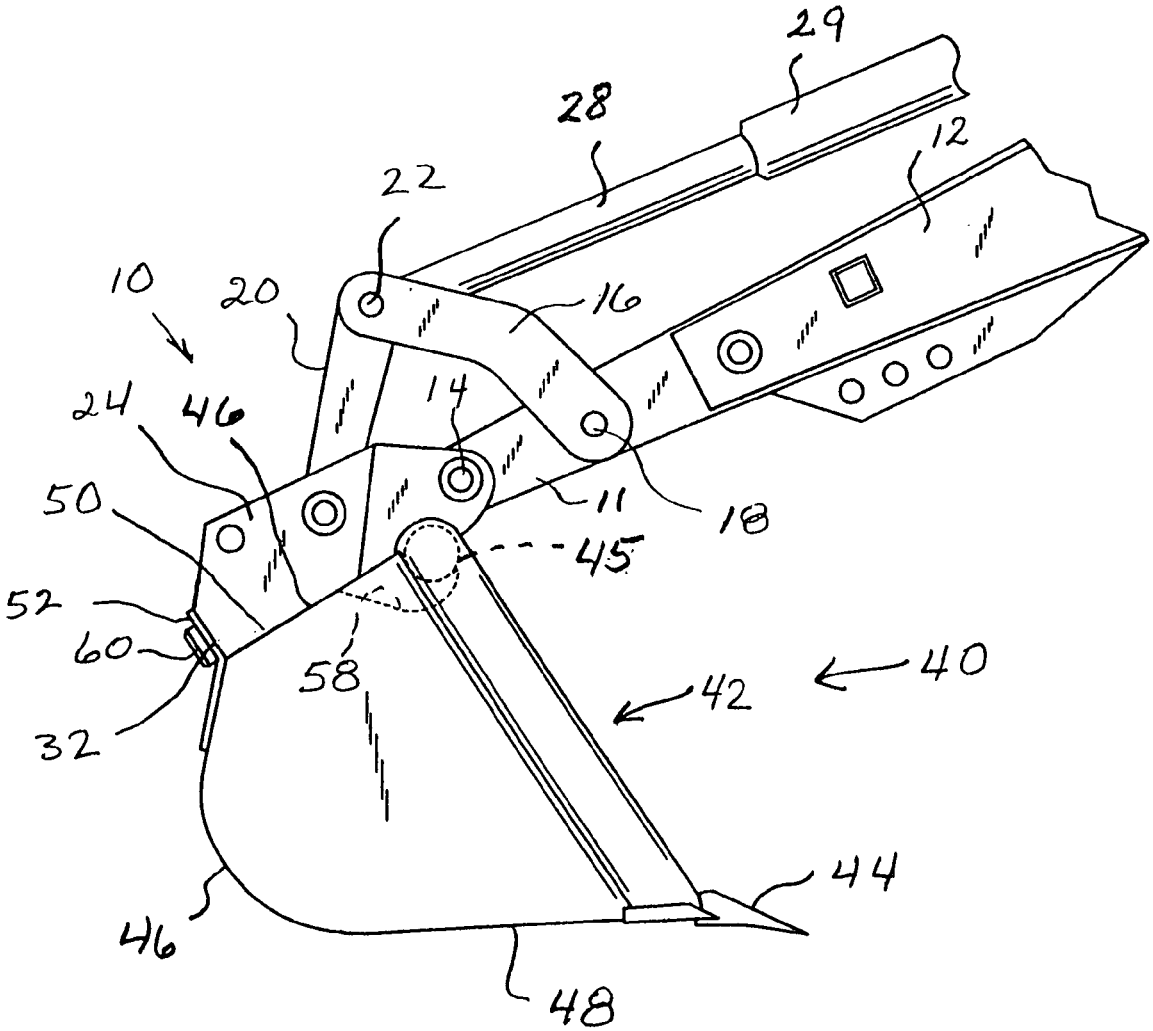
FIG. 1 PRIOR ART
FIG. 1 is a side elevational view showing a Wain-Roy-style coupler at the free end of a backhoe mounting arm joined to a backhoe bucket that is oriented in its normal orientation relative to the backhoe vehicle chassis.
Figure 2:
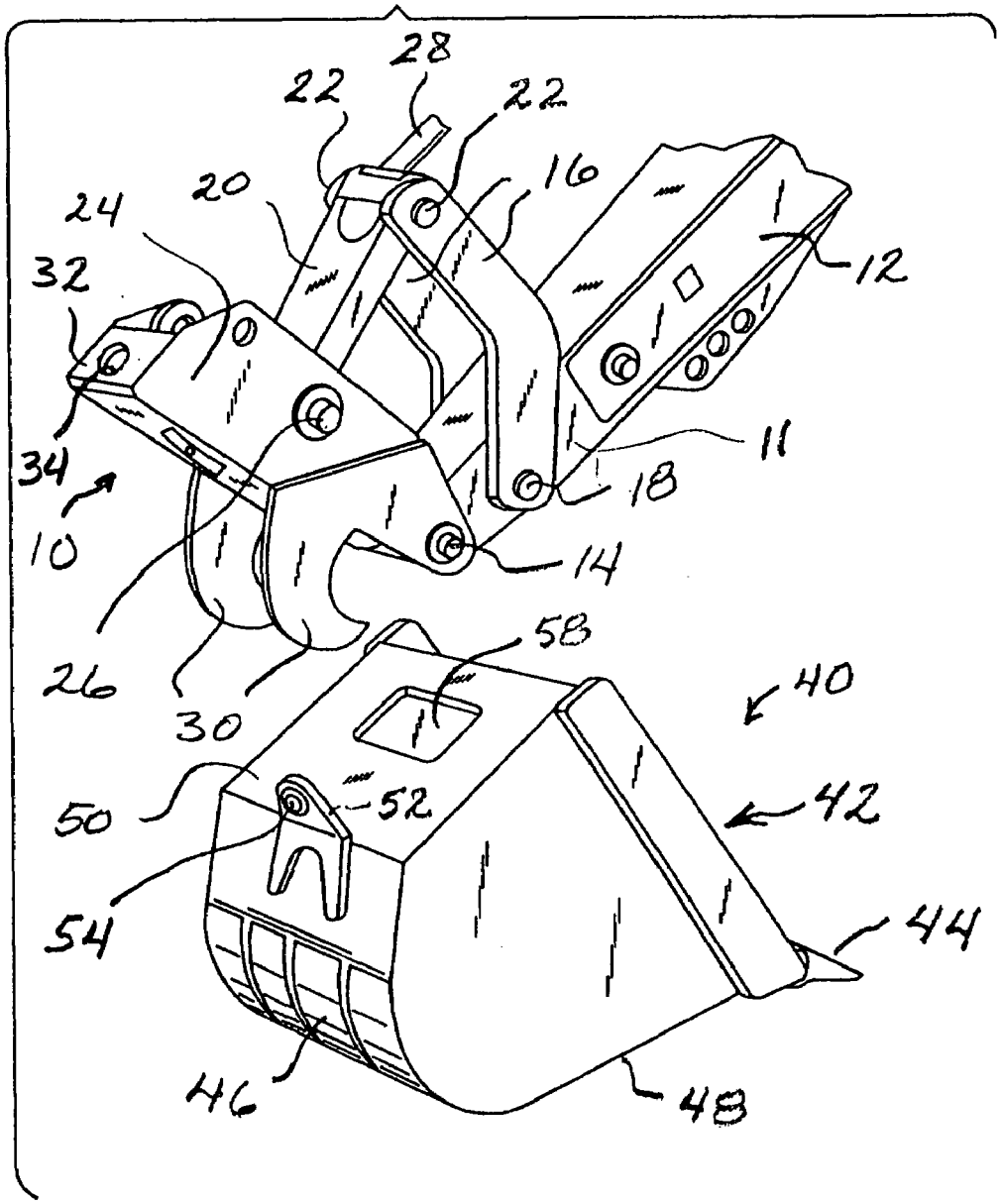
FIG. 2 PRIOR ART
FIG. 2 is a perspective view illustrating the coupler of FIG. 1 released from the bucket shown in FIG. 1.
Figure 8:
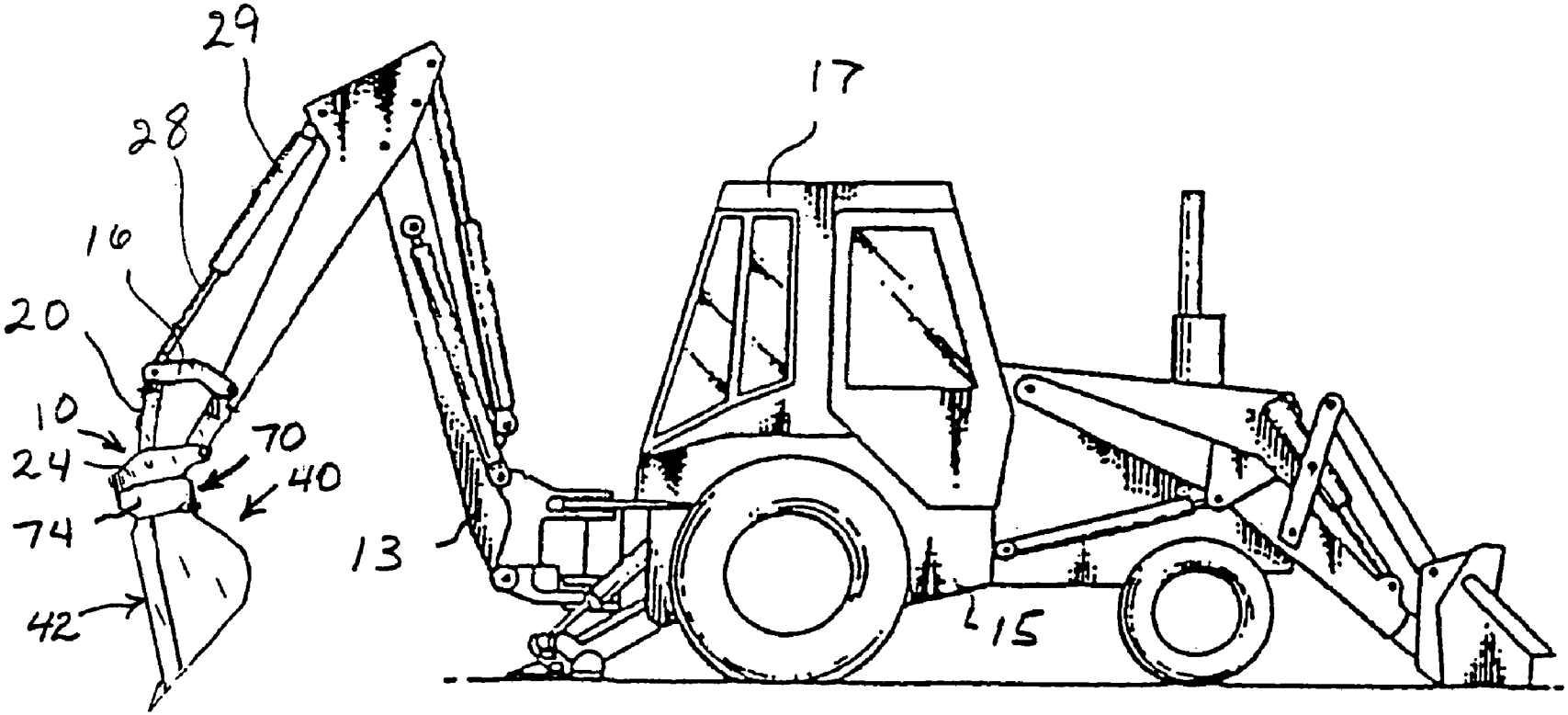
FIG. 8 illustrates a backhoe vehicle employing the backhoe bucket reverse adapter according to the present invention.

FIGS. 1 and 2 illustrate the free end 11 of a conventional articulated backhoe arm 12, the opposite end 13 of which is anchored to the chassis 15 of a conventional backhoe vehicle, such as the backhoe vehicle 17 illustrated in FIG. 8. The construction of the backhoe arm 12 and the backhoe vehicle 17 are conventional and need not be described in any great detail herein. U.S. Pat. No. 5,145,313 depicts and describes such a conventional backhoe arrangement and is hereby incorporated by reference in its entirety.

The conventional Wain-Roy-style backhoe bucket engaging system illustrated in FIGS. 1 and 2 is provided with a hydraulic coupler assembly 10 that is attached to the free end 11 of the backhoe arm 12 at a hinged connection 14. The anchored end 13 of the backhoe arm 12 is rotatably joined to the chassis of the backhoe vehicle 17 at a hinged connection 19, shown in FIG. 8, and which is located out of view, off to the right considered with respect to FIGS. 1 and 2.

The backhoe arm linkage includes a pair of dog-leg-shaped bucket guide links 16 located on opposing sides of the free end 11 of the backhoe arm 12. A pair of pivot fixtures 18 are located near a forward end of the side walls of the free end 11 of the backhoe arm 12 so that the bucket guide links 16 are also rotatably joined to the backhoe arm 12.

The coupling assembly 10 also includes a bucket link 20 that is pivotably joined to the bucket guide links 16 by rotatable connections 22 and also to the coupler frame 24 by means of a hinge connection 26. The coupler assembly 10 is rotated relative to the backhoe arm 12 by the reciprocal action of a hydraulically operated piston 28 which is extended from and retracted into the hydraulic cylinder 29, visible in FIGS. 1 and 8.

The coupler frame 24 has a generally U-shaped cross-sectional configuration and is open at the top. In the conventional Wain-Roy-style coupler system illustrated in FIGS. 1 and 2, the coupler assembler 10 is provided with a pair of hook elements 30 depending from the sides of the coupler framework 24 and a transverse bucket coupler faceplate 32 extending across the forward end of the coupler framework 24.

The directional convention adopted for purposes of describing the structures depicted herein utilizes the term "forward" as indicating a direction remote from the backhoe vehicle chassis 15, while the term "rear" or "rearward" indicates a direction closest to the backhoe vehicle chassis 15. That is, with reference to FIGS. 1, 2, and 7, the term "forward" is a directional term indicating objects at the left-hand side of the drawing figures, while the term "rear" or "rearward" is a directional designation indicating objects at the right-hand side of those drawing figures. This same directional convention is also evident in FIG. 8. The term "back", as applied to components of the bucket 40, refers to the side of the bucket containing the backhoe attachment mechanism. The term "front" as applied to the components of the bucket 40 refers to the side of the bucket 40 at which the digging teeth 44 are formed.

The bucket coupler faceplate 32 on the coupling assembly 10 is provided with a latch pin opening 34 defined therein. The opening 34 as formed includes a bushing welded to the faceplate 32 within the coupler frame 24.

The bucket 40 is a conventional backhoe excavation bucket having an open upper mouth 42 at its upper end with excavating teeth 44 located at the top of its front side 48 and with a section of steel tubing 45 having a diameter of about four inches, indicated in FIG. 1, located at the top of the backside 46 of the bucket 40. The mouth 42 is located at the top of the bucket 40, while the bottom 46 of the bucket 40 is closed and has a concave upwardly facing curvature between the bucket front wall 48 and the bucket back wall 50 so as to reduce lodging of soil and other excavation material within the bucket 40.

The back tubular cross-connecting member 45 is located at the top of the bucket 40. A transverse latch pin tang 52 with a latch pin aperture 54 defined therethrough is located near the bottom of the bucket 40 and is secured to the back wall 50 thereof.

The bucket 40 is provided with a hook receiving cavity 58 that is defined in the top back wall 50 between the back cross-connecting member 45 and the bottom transverse latch pin tang 52. The cavity 58 is configured to receive the hooks 30 of the coupling assembly 10, as illustrated in FIGS. 1 and 2.

The coupling assembly 10 may be releaseably attached to the bucket 40 quickly and easily by insertion of the hooks 30 into the cavity 58 beneath the back cross-connecting member 45, and reciprocal operation of the piston 28 within the cylinder 29 to bring the coupler framework 24 down into contact with the back wall 50 of the bucket 40. The apertures 34 and 54 are thereupon coaxially coaligned with each other so that a latch pin 60 may be inserted through the apertures 34 and 54 to releaseably secure the bucket 40 to the coupler assembly 10, as illustrated in FIG. 1.

When the bucket 40 is connected to the coupler assembly 10 in a conventional manner, the open mouth 42 of the bucket 40 is oriented generally in a rearward direction, that is, a direction substantially facing the backhoe vehicle chassis 15. That is, as illustrated in FIG. 1, the mouth 42 of the bucket 40 is oriented more or less in a direction facing to the right, even when the hydraulic piston 28 is retracted into the hydraulic cylinder 29. This is the normal orientation of a backhoe bucket 40 relative to the backhoe mounting arm 12 and backhoe vehicle chassis 15 for most operations.

When the backhoe bucket 40 is to be released in order to attach a different implement to the backhoe mounting arm 12, the latch pin 60 is loosened and withdrawn from the opening 54 in the transverse bucket latch pin tang 52 and from the opening 34 in the faceplate 32 of the coupler frame 24. The hydraulic piston 28 is thereupon retracted, thereby withdrawing the hooks 30 out from the cavity 58 and releasing the bucket 40.

The attachment mechanisms illustrated and described in FIGS. 1 and 2 are conventional and are substantially as illustrated and described in U.S. Pat. Nos. 5,727,342 and 5,966,850, both of which are hereby incorporated by reference in their entireties.

In some circumstances, however, it is extremely advantageous for the orientation of the backhoe bucket 40 relative to its mounting arm 12 to be reversed. That is, while the conventional orientation of the backhoe bucket 40 as illustrated in FIGS. 1 and 2 is quite suitable for scooping up large volumes of earth and other excavation material toward the chassis 15 of the backhoe vehicle 17, there are other circumstances in which it would be highly advantageous for the bucket 40 to be reversed relative to the mounting arm 12. That is, it is sometimes advantageous to reverse the bucket 40 from a rearwardly facing orientation, as illustrated in FIG. 1, to an opposite, forwardly facing orientation, as illustrated in FIG. 8. For example, it would be highly desirable to reverse the orientation of the bucket 40 relative to the mounting arm 12 in order to excavate material from beneath paved streets or sidewalks. Such an operation cannot be performed with the backhoe bucket 40 oriented in its normal orientation illustrated in FIGS. 1 and 2.

Over the years various systems have been devised for reversing the orientation of some types of backhoe buckets relative to the hydraulically operated mounting arms to which they are attached. However, no such system has existed for the Gannon-style or Wain-Roy-style bucket coupling arrangements of the type illustrated in FIGS. 1 and 2. The Gannon-style and Wain-Roy-style bucket coupling systems have gained considerable commercial acceptance over many years due to the quick and easy bucket release capability, yet a suitable apparatus for reversing bucket orientation in these systems has not heretofore been available.

According to the present invention a backhoe bucket reverse adapter 70 has been devised that allows a bucket 40 to be reversed in orientation on a backhoe mounting arm 12 employing the Wain-Roy-style and Gannon-style coupling systems 10. The backhoe bucket reverse adapter 70 is illustrated in isolation in FIGS. 3-6.

The backhoe bucket reverse adapter 70 is comprised of an adapter framework 72 that includes a pair of flat, transversely separated, mutually parallel side plates 74 and 76. The adapter framework side plates 74 and 76 are rigidly joined to each other by opposing end connectors. Specifically, a first, foreword end cross-connector 78 rigidly joins the forward ends of the adapter framework side plates 74 and 76, while a second rear adapter end cross-connector 80 extends between the rear ends of the framework side plates 74 and 76.

Figure 3:
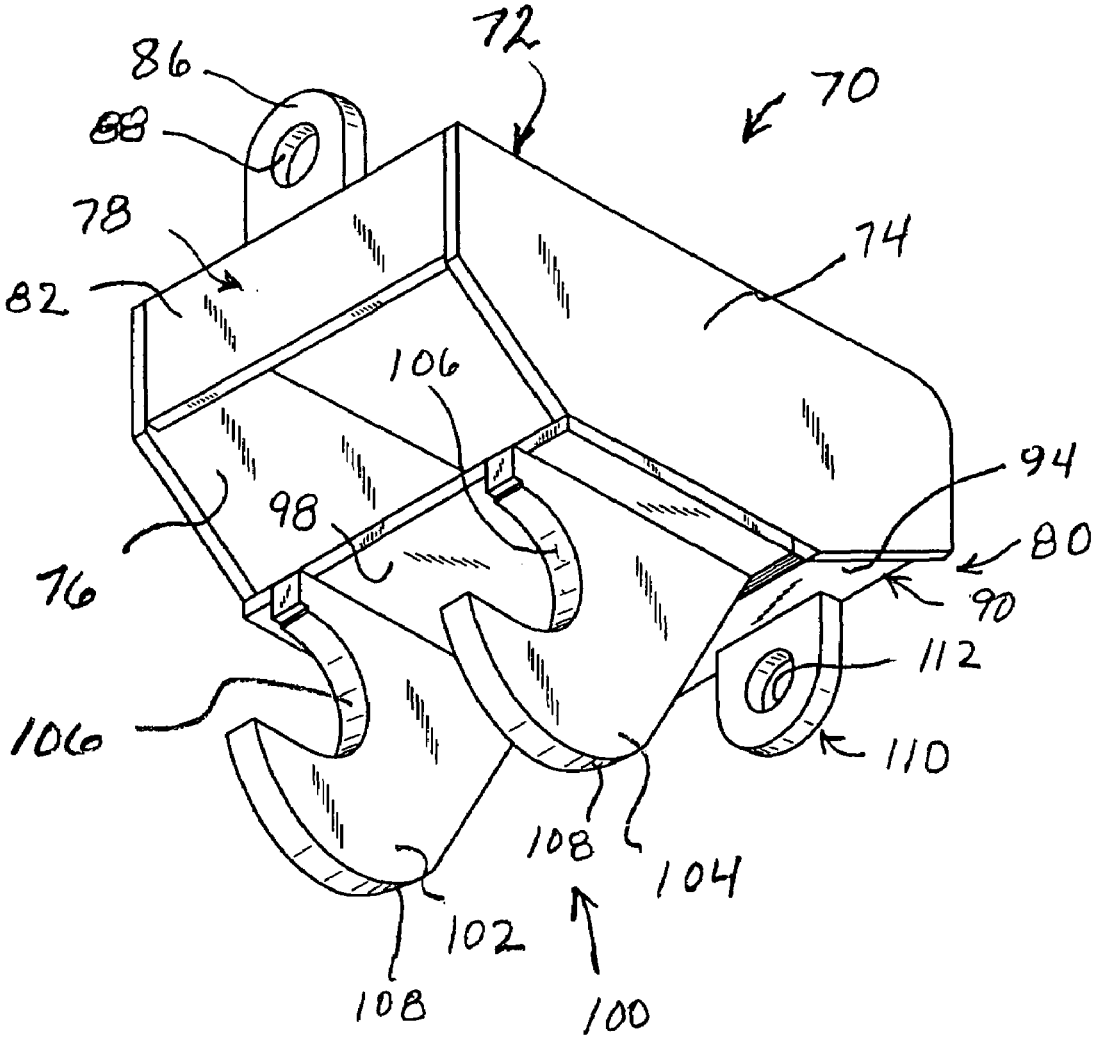
FIG. 3 is a perspective view from in front of the underside of a preferred embodiment of a backhoe bucket reverse adapter constructed according to the present invention.
Figure 4:
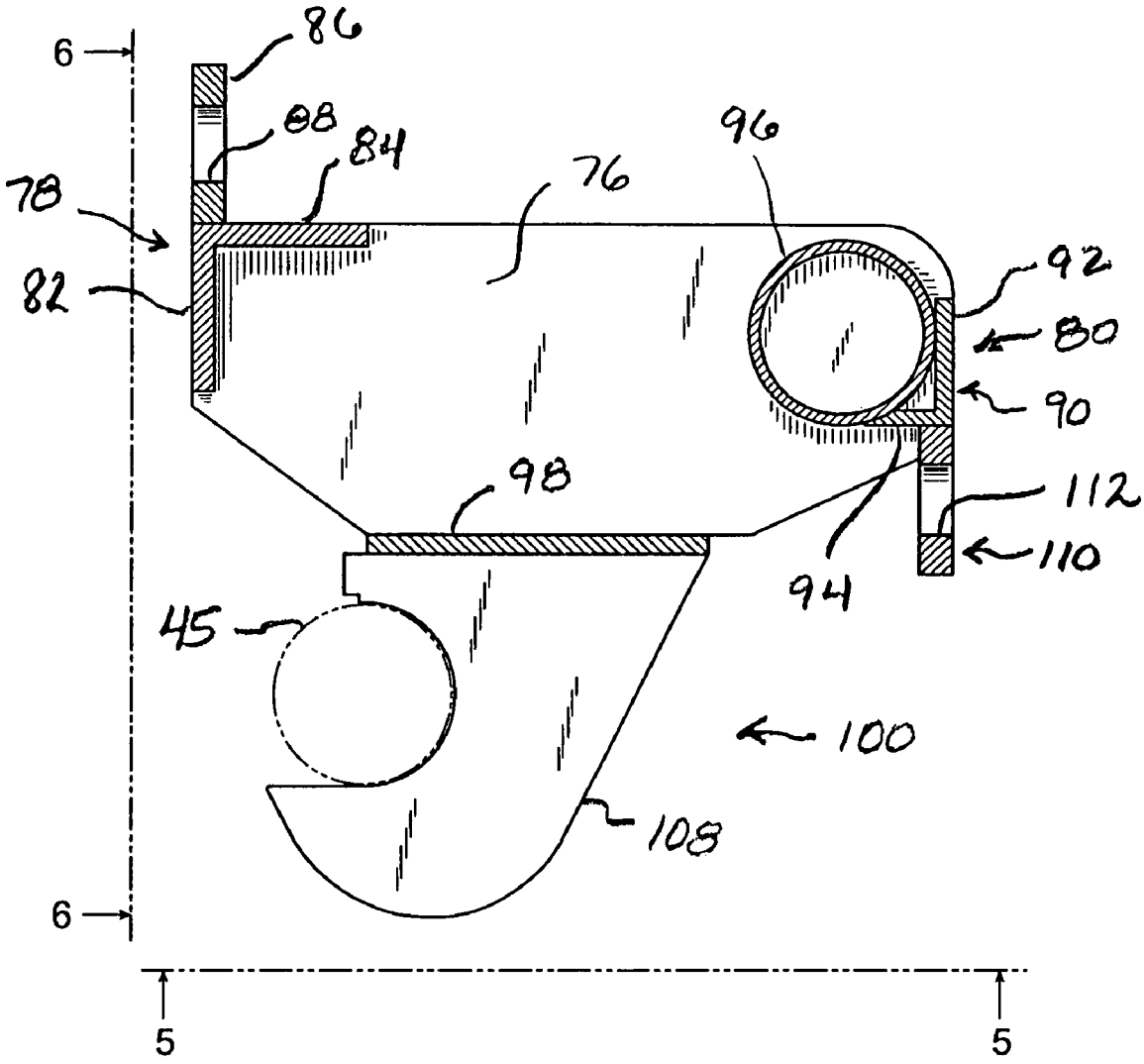
FIG. 4 is an elevational sectional view of the backhoe bucket reverse adapter shown in FIG. 3.
Figure 5:
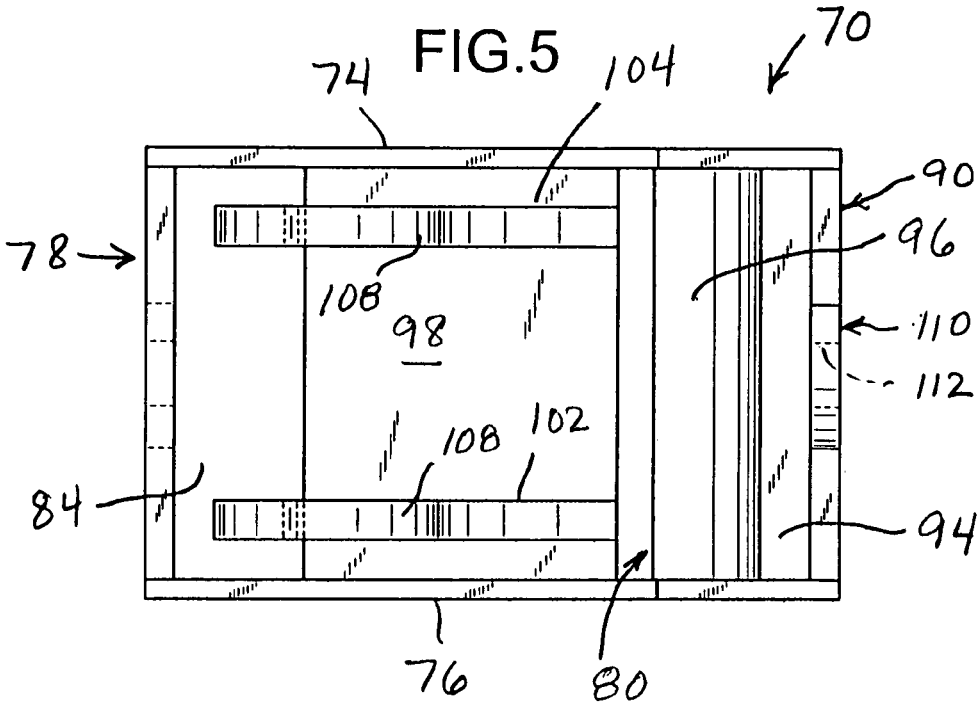
FIG. 5 is a bottom plan view of the backhoe bucket reverse adapter taken along the lines 5-5 of FIG. 4.
Figure 6:
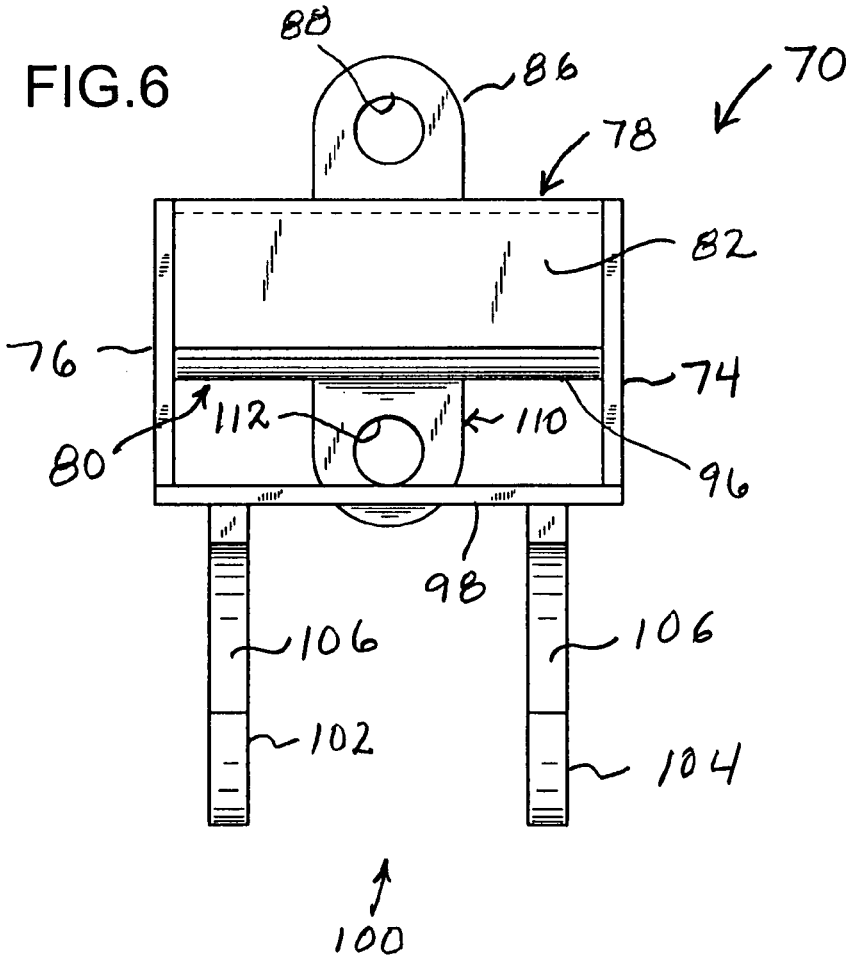
FIG. 6 is an end elevational view from the front end of the backhoe bucket reverse adapter, taken along the lines 6-6 of FIG. 4.

The adapter foreword end connector 78 is preferably comprised of a transverse, foreword angle piece having legs 82 and 84 oriented at right angles to each other, as best illustrated in FIG. 4. The angle piece 78 extends between the foreword ends of the adapter side plates 74 and 76 and is welded to the inside surfaces thereof. As illustrated in FIGS. 3, 4, and 6, the backhoe bucket reverse adapter 70 is provided with a backhoe arm coupling link tang 86 that projects upwardly from the foreword adapter end connector 78. The backhoe arm coupling link tang 86 has a central, circular opening 88 defined therethrough, which is the same diameter as the opening 34 in the coupler faceplate 32. The backhoe arm coupling link tang 86 projects upwardly perpendicular to the leg 84 of the angle piece 78 and in a direction opposite the leg 82 thereof. The backhoe arm coupling link tang 86 is narrower in width than the foreword end connector 78 and is centered atop the angle leg 84.

The adapter rear end connector 80 is also comprised of a transverse rear angle piece 90 extending between the rear ends of the side plates 74 and 76. The angle piece 90 has an upwardly projecting leg 92 and a forwardly projecting leg 94 oriented perpendicular to the leg 92. The adapter end connector 80 is further comprised of a four inch diameter, hollow, section of steel tubing 96 that is welded to the mutually facing inwardly facing surfaces of the adapter side walls 74 and 76. The steel tubing 96 is also welded to the angle piece 90.

The backhoe bucket reverse adapter 70 is further comprised of a flat, transverse bottom plate 98 that is welded across the center of the bottom edges of the adapter side walls 74 and 76. The backhoe bucket reverse adapter 70 is further comprised of a hook assembly 100 that includes at least one, and preferably, a pair of hook elements 102 and 104, as illustrated. The hook elements 102 and 104 depend from the adapter framework 72 and are welded to the underside of the bottom plate 98 inboard from the side walls 74 and 76. The hook elements 102 and 104 are formed as flat hook-shaped slabs of steel that are transversely spaced apart from each other and located inboard from and parallel to the side plates 74 and 76. The hook elements 102 and 104 are identical to each other and each has a concave side 106 that faces the foreword adapter end connector 78, and a convex side 108 that faces the rear adapter end connector 80. The concave sides 106 of the hook elements 102 and 104 form four inch diameter, arcuately curved recesses that are of a size and shape to form seats that snugly receive and fit about the outer surface of the back cross-connecting steel tube 45 at the top of the bucket 40, as illustrated in phantom in FIG. 4.

The backhoe bucket reverse adapter 70 is further provided with an adapter bucket coupling tang 110 that depends from the transverse rear adapter end connector 80. The adapter bucket coupling tang 110 has a central, circular aperture 112 defined therethrough. This aperture 112 has the same diameter as the aperture 54 in the bucket latch pin tang 52. The adapter bucket coupling tang 110 is narrower than the transverse rear adapter end connector 80 and is centered to depend from the underside of the leg 94 of the rear adapter end connector angle piece 90.

In the construction of the backhoe bucket reverse adapter 70, it is important for a gap to exist between the bottom plate 98 and at least the rear adapter end connector 80. This gap is necessary in order to accommodate the hook elements 30 of the bucket coupler assembly 10. In the preferred embodiment of the invention a gap also exists between the bottom plate 98 and the foreword adapter end connector 78.

As illustrated in FIG. 4, the backhoe arm coupling link tang 86 projects upwardly between the adapter framework sides 74 and 76 from the first, foreword adapter end connector 78 in a direction opposite the adapter hook assembly 100. The bucket coupling link tang 110 projects from the second, rear end cross-connector 80 between the adapter sides 74 and 76 in the same direction as the hook assembly 100 and in a direction opposite the backhoe arm coupling link tang 86.

Figure 7:
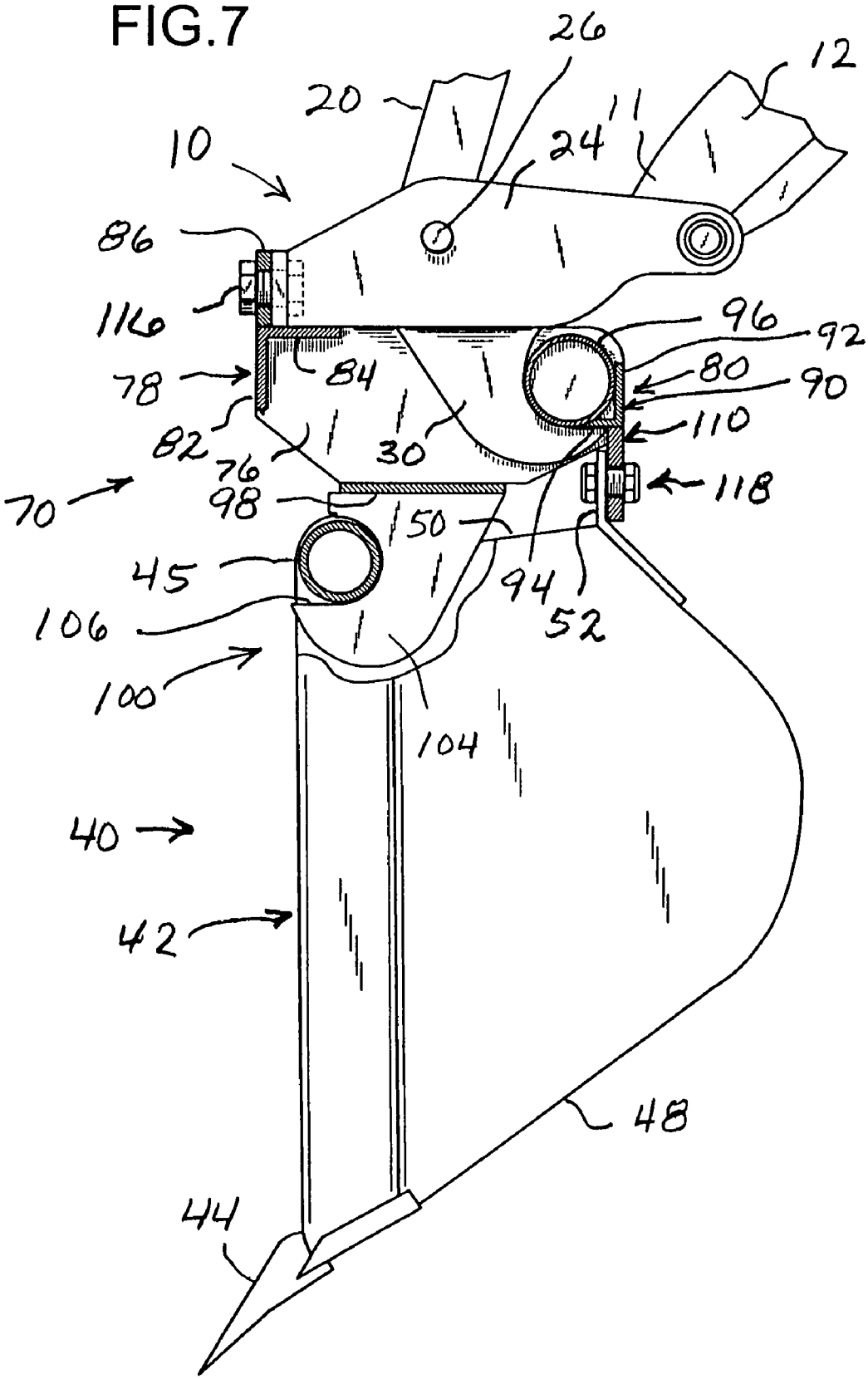
FIG. 7 illustrates the backhoe bucket reverse adapter of FIG. 3 interposed between the Gannon-style or Wain-Roy-style coupler and bucket of FIGS. 1 and 2.

FIGS. 7 and 8 illustrate the backhoe bucket reverse adapter 70 of the invention interposed between the bucket coupler assembly 10 and the backhoe bucket 40 previously described in conjunction with FIGS. 1 and 2. More specifically, the backhoe bucket reverse adapter 70 is releaseably connected to the coupler assembly 10 by actuating and extending the piston 28 from the cylinder 29 so as to bring the hook elements 30 of the backhoe arm hook assembly up underneath the rear end cross-member tube 96 of the backhoe bucket reverse adapter 70 in the same manner as the hooks 30 normally engage the tubular back cross-connecting member 45 of the bucket 40.

The bottom of the coupler framework 24 is thereby brought down into contact with the upper edges of the backhoe bucket reverse adapter side walls 74 and 76 and with the top leg 84 of the transverse first, foreword adapter end connector 78. The faceplate 32 of the coupler framework 24 thereupon resides in face to face relationship with the backhoe arm coupling link tang 86. The apertures 88 and 34 thereby reside in coaxial alignment with each other so that a releaseable mounting arm-adapter coupling pin 116 may be used and inserted to extend through the openings 34 and 88. The coupling pin 116 thereby firmly, but releaseably, secures the bucket coupler assembly 10 to the backhoe bucket reverse adapter 70. That is, the hooks 30 of the coupling assembly 30 firmly engage the tubular steel member 96 of the second or rear adapter end connector 80, while the mounting arm-adapter coupling pin 116 firmly secures the upstanding backhoe arm coupling link tang 86 to the coupling framework faceplate 32.

The backhoe bucket reverse adapter 70 is then maneuvered into position relative to the bucket 40 so that the foreword end connector 78 of the bucket reverse adapter 70 is located proximate the open mouth 42 of the bucket 40. The hydraulic piston 28 is then actuated to bring the adapter hooks 102 and 104 down into the cavity 58' in the back wall 50 of the bucket 40 and forwardly so as to capture and seat beneath the back cross-connecting tube member 45 at the top of the bucket 40. The piston 28 is actuated to manipulate the backhoe bucket reverse adapter 70 so that the adapter bucket coupling link tang 110 thereof resides in face to face relationship with the transverse latch pin tang 52 near the bottom of the bucket 40 at the back wall 50 thereof, as illustrated in FIG. 7. The apertures 54 and 112 are thereupon in mutual coaxial alignment so that a releaseable adapter-bucket coupling pin 118 can be used to join the coupling tangs 52 and 110 together. That is, the shank of the releaseable adapter-bucket coupling pin 118 is inserted through the mutually coaxial aligned apertures 54 and 112, and the coupling pin 118 is releaseably secured.

The coupling or latch pins 116 and 118 may be any type of conventional releaseably fasteners that pass through coaxially aligned apertures. For example, the coupling pins 116 and 118 may be formed as bolts have threaded shanks equipped with nuts, twist-lock connectors, cam lock connectors, or any other structurally strong conventional type of coupling.

When the backhoe bucket reverse adapter 70 is interposed between the coupler assembly 10 and the bucket 40, the bucket 40 is joined to the mounting arm 12 facing in the reverse direction from its normal orientation, as illustrated in FIG. 8. The hook elements 30 projecting downwardly from the backhoe arm 12 conform to and cradle the second, rear tubular steel four inch diameter section of tubing 96 at the rear end of the backhoe bucket reverse adapter 70, as illustrated in FIG. 7. By the same token, the downwardly depending hook elements 102 and 104 of the backhoe bucket reverse adapter 70 are directed forwardly, in the opposite direction from the hook elements 30. The hook elements 102 and 104 thereby receive and cradle the tubular back cross-connecting member 45 at the top of the bucket 40. The bucket 40 can thereby be manipulated from the position depicted in FIGS. 7 and 8 to excavate by scooping in a forward direction, rather than in a rearward direction. By employing the backhoe bucket reverse adapter 70 between the mounting arm 12 and the bucket 40, it is possible to operate the bucket 40 so as to scoop material with a forward scooping action away from the backhoe vehicle 17, as illustrated in FIG. 8, rather than a rearward scooping action toward the backhoe vehicle 17 that is employed when the backhoe 40 is mounted in its normal orientation in the manner illustrated in FIG. 1.

The backhoe bucket reverse adapter 70 is extremely useful so as to temporarily reverse the direction of scooping action of the bucket 40 for specific purposes. The adapter 70 can be easily connected to and disconnected from the bucket 40 and the coupling unit 10 by merely releasing the latch pins 116 and 118 and manipulating the hydraulic piston 28 so as to withdraw the hooks 30 from engagement with the adapter 70.

Undoubtedly, numerous variations and modifications of the invention will become readily apparent to those familiar with backhoe bucket coupling systems. While the steel tube 45 at the top of the bucket 40 illustrated and described is about four inches in diameter, buckets having tube members of other diameters are also commercially available. For example, the steel tube 45 could be anywhere from between about two to about eight inches in diameter. Accordingly, the scope of the invention should not be construed as limited to the specific embodiment depicted and described, but rather is defined in the claims appended hereto.

I claim:

1. A backhoe bucket reverse adapter for use with a backhoe arm having a depending bucket hook assembly and with a backhoe bucket having a back wall with a cross-connecting member at its top, a latch pin plate at its bottom, and a hook-receiving cavity located therebetween comprising:

an adapter framework including a pair of transversely separated side plates rigidly joined to each other by opposing transverse foreword and rear adapter end connectors, an adapter hook assembly depending from said adapter framework and having at least one hook element with a concave side facing said foreword adapter end connector, a backhoe arm coupling link member projecting upwardly from said foreword adapter end connector in a direction opposite said adapter hook assembly, and an adapter bucket coupling member depending from said transverse rear adapter end connector.

2. An adapter according to claim 1 wherein said side plates of said adapter are mutually parallel to each other and said transverse rear adapter end connector includes a transverse cylindrical, tubular structure.

3. An adapter according to claim 2 wherein said adapter hook assembly has a pair of hook elements, both configured as aforesaid, and said hook elements are spaced transversely apart from each other and are parallel to and located inboard from said side plates.

4. An adapter according to claim 3 further comprising a transverse bottom plate secured to said side plates so as to leave a gap between said bottom plate and said rear adapter end connector and wherein said hook elements both depend from said bottom plate.

5. An adapter according to claim 4 wherein said rear adapter end connector is additionally comprised of a transverse rear angle piece extending between said side plates adjacent said cylindrical, tubular structure, and said adapter bucket coupling member is a tang that depends from the center of said rear angle piece.

6. An adapter according to claim 4 wherein said foreword adapter is comprised of a transverse foreword angle piece extending between said side plates, and said backhoe arm coupling link member is a tang that projects upwardly from the center of said foreword angle piece.

7. An adapter according to claim 1 constructed entirely of steel.

8. A backhoe bucket reverse adapter for use with a backhoe arm having a depending bucket hook assembly and for use with a backhoe bucket having a back wall with a cavity defined therein to receive said backhoe arm bucket hook assembly comprising:

an adapter framework having transversely separated sides rigidly joined to each other by opposing first and second end cross-connectors, thereby defining openings at the top and bottom of said adapter framework, an adapter hook assembly having at least one hook element depending from said adapter framework and formed concave toward said first cross-connector and convex toward said second cross-connector, a backhoe arm coupling link member projecting away from said adapter framework at said first end cross-connector in a direction opposite said adapter hook assembly, and a bucket coupling link member projecting away from said adapter framework at said second end cross-connector in a direction opposite said backhoe arm coupling link member.

9. An adapter according to claim 8 wherein said first and second cross-connectors are respectively comprised of first and second angle pieces extending between said adapter sides at opposing ends thereof.

10. An adapter according to claim 9 wherein said second cross-connector is further comprised of a hollow cylindrical member.

11. An adapter according to claim 10 wherein said hollow cylindrical member has an outer diameter of four inches.

12. An adapter according to claim 11 further comprising a transverse bottom plate secured to said side plates so as to leave gaps between said bottom plate and both said cross-connectors and said hook assembly includes a pair of said hook elements as aforesaid depending from said bottom plate.

13. An adapter according to claim 12 wherein said backhoe arm coupling link member and said bucket coupling link member are formed of centrally located plates that project from said first and second cross-members, respectively.

14. In combination a backhoe arm having a free end and an opposite anchored end with a bucket coupler assembly rotatably connected to said free end of said backhoe arm, wherein said bucket coupler assembly has a transverse bucket coupler faceplate with a latch pin opening defined therein and a depending hook assembly located between said transverse bucket coupler faceplate and said anchored end of said backhoe arm, with at least one hook element provided thereon that is configured concave toward said anchored end of said backhoe arm, a backhoe bucket having an open mouth at its top and a back wall with a back cross-connecting member at said top of said bucket, a transverse latch pin tang with a latch pin aperture defined therethrough, and a hook receiving cavity defined in said back wall between said back cross-connecting member and said transverse latch pin tang, and a backhoe bucket reverse adapter including:

(a) an adapter framework formed with a pair of transversely separated side plates rigidly joined to each other by opposing transverse first and second adapter end connectors, (b) an adapter hook assembly depending from said adapter framework and having at least one hook element having a concave side facing said first adapter end connector and a convex side facing said second adapter end connector, (c) a transversely oriented backhoe arm coupling link tang with a latch pin opening defined therein projecting from said first adapter end connector in a direction opposite said adapter hook assembly, and (d) a transversely oriented adapter bucket coupling tang with a latch pin aperture defined therethrough extending from said second adapter end connector, wherein said backhoe bucket reverse adapter is interposed between said bucket coupler assembly and said backhoe bucket such that said adapter backhoe arm coupling link tang and said bucket coupler faceplate reside in face to face contact with each other with said openings therethrough in alignment with each other, and further comprising a releaseable mounting arm adapter coupling pin extending through said openings, and said backhoe bucket latch pin tang and said adapter bucket coupling tang reside in face to face contact with each other with said apertures therethrough in coaxial alignment with each other, and further comprising a releaseable adapter bucket coupling pin extending through said apertures, whereby said hook element of said coupler assembly engages said second adapter connector and said hook element of said adapter engages said back cross-connecting member at said top of said bucket.

15. A combination according to claim 14 where said back cross-connecting member at said top of said bucket is comprised of a section of hollow steel tubing, and said at least one hook element of said backhoe arm and said at least one hook element of said backhoe bucket reverse adapter are both configured to conform to and cradle said section of hollow steel tubing at said top of said bucket.

16. A combination according to claim 15 wherein both said backhoe arm and said backhoe bucket reverse adapter are each provided with a pair of transversely spaced hook elements as aforesaid.

* * * * *